United States Patent [19]

Meierhoefer

[11] Patent Number: 4,502,616

[45] Date of Patent: Mar. 5, 1985

[54] SINGLE USE VIAL

[75] Inventor: Eugene J. Meierhoefer, Hackettstoun, N.J.

[73] Assignee: Health Care Concepts, Inc., Allamuchy, N.J.

[21] Appl. No.: 337,080

[22] Filed: Jan. 4, 1982

[51] Int. Cl.[3] ..... B67D 5/56; B65D 35/08

[52] U.S. Cl. ..... 222/215; 222/129; 222/541; 604/200

[58] Field of Search ..... 206/484.2, 484; 604/200, 244, 403; 222/94, 107, 129, 143, 206, 215, 541

[56] References Cited

U.S. PATENT DOCUMENTS

| | | | |
|---|---|---|---|
| 128,699 | 7/1872 | Bostwick | 222/173 |
| 2,663,461 | 12/1953 | Brown | 222/107 |
| 3,128,920 | 4/1964 | Volckening et al. | 222/215 |
| 3,552,638 | 1/1971 | Quackenbush | 206/484 |
| 3,717,244 | 2/1973 | Smith | 206/484 |
| 3,862,684 | 1/1975 | Schmitt | 222/107 X |
| 3,917,120 | 11/1975 | Larenz et al. | 222/541 X |
| 3,993,223 | 11/1976 | Welker et al. | 222/541 X |
| 4,052,986 | 10/1977 | Scaife | 222/541 X |

*Primary Examiner*—David A. Scherbel
*Attorney, Agent, or Firm*—William E. Hedges

[57] ABSTRACT

A single use vial is provided in clusters of five or two times five separably joined vials. The vials are molded and filled with a medicated or non-medicated solution and each vial is provided with a converging, planar front wall. The vials include an integral dispensing nozzle, having a conduit which can be exposed by removing a twist off closure. A common separation strip joins the facing side of adjacent vials in the cluster but not the twist off closures. The angle of convergence of the front wall is designed to elevate the conduit above the solution level when the front wall is placed upon a horizontal surface to prevent unwanted dripping prior to use.

2 Claims, 13 Drawing Figures

FIG. 1
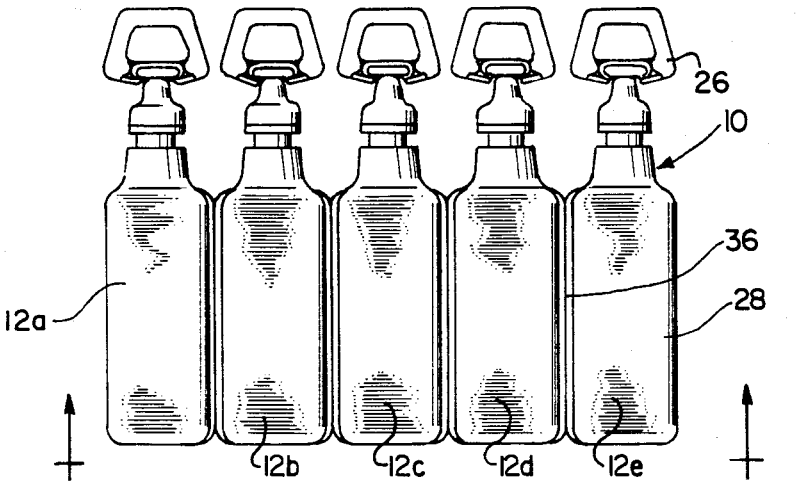
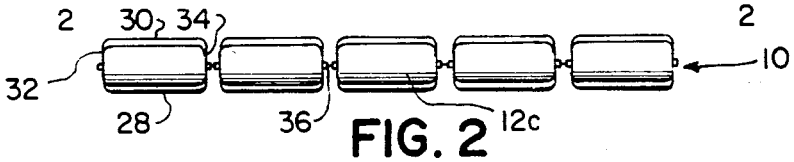
FIG. 2
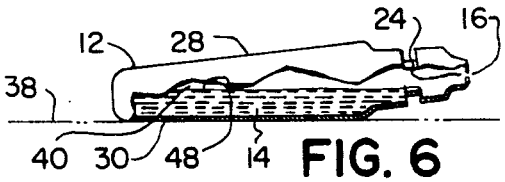
FIG. 6
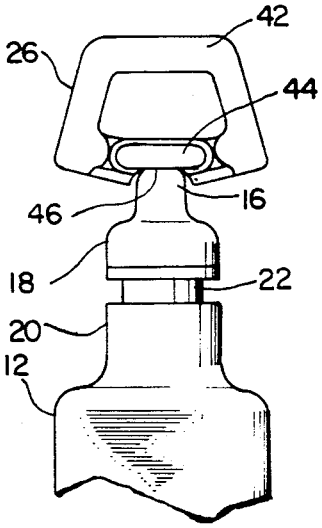
FIG. 3
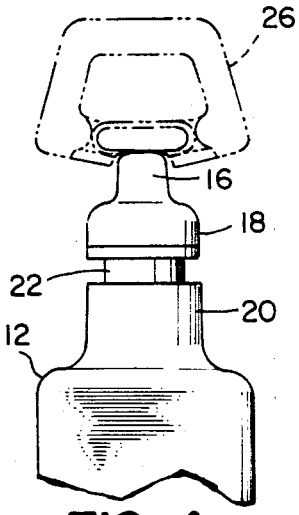
FIG. 4
FIG. 5
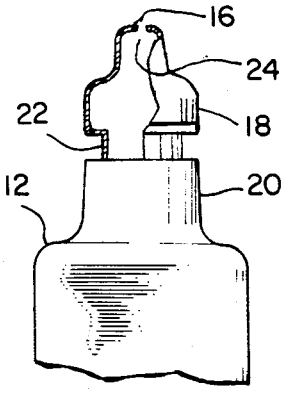

FIG. 7
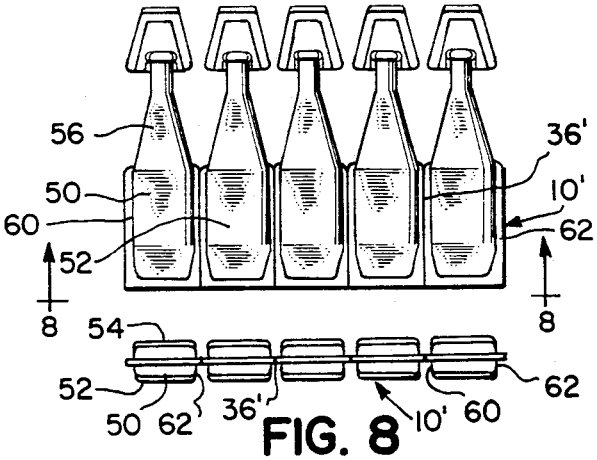
FIG. 8
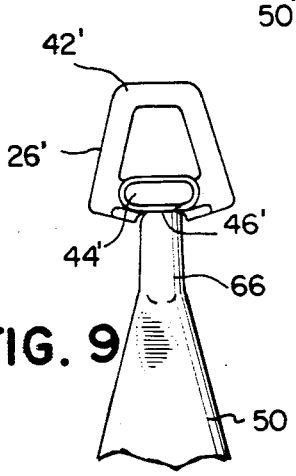
FIG. 9
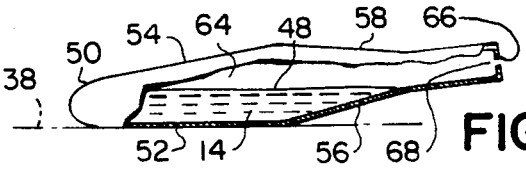
FIG. 11
FIG. 13
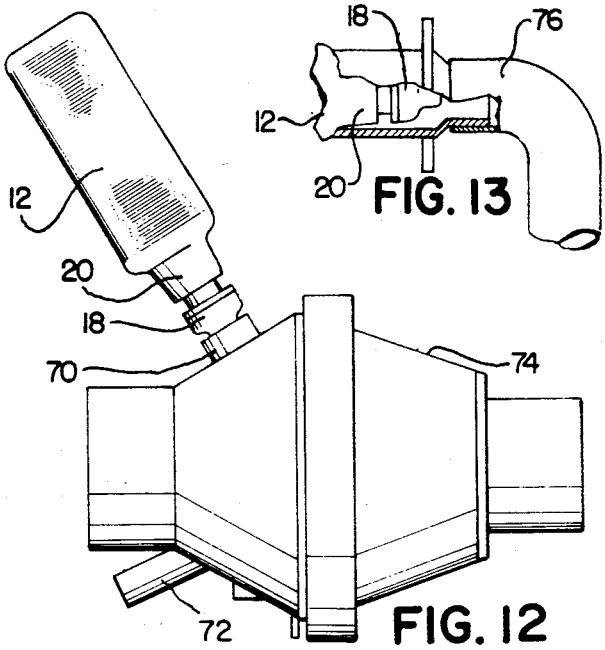
FIG. 12
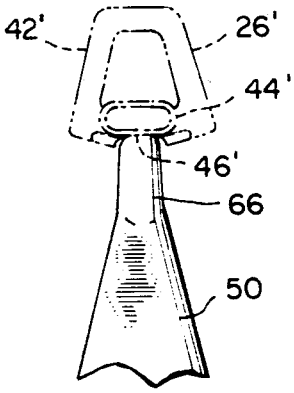
FIG. 10

SINGLE USE VIAL

BACKGROUND OF THE INVENTION

The present invention relates generally to the field non-reclosable packages, and more particularly is directed to a novel single use vial suitable for storing and dispensing a quantity of either non-preserved or preserved product.

For certain treatments in the field of respiratory therapy patient administration sets, or circuits, commmonly employ the use of a nebulization device, said device incorporating a fluid reservoir to contain the solution or medication to be administered. Some of nebulizer reservoirs are fitted with a special medication port, or opening, through which the solution to be nebulized may be added, provided the solution is contained in a package that will cooperate with, or fit into the port. If the package containing the solution to be nebulized does not fit into the medication port then the nebulizer unit, or a portion of the circuit, must be partially disassembled in order to place the solution in the reservoir. The nebulizer, or circuit, must then be reassembled prior to use. Alternatively, if the solution to be nebulized is presented in a container unsuitable for filling the reservoir, the solution is usually drawn-up into a syringe for the purpose of metering and delivering the solution via the medication port, into the reservoir. The nebulizer, or circuit, must then be reassembled prior to use. This manipulation not only imposes additional cost in operator time but incurs the added expense of the syringe and needle.

In the field of nursing and the various facets of patient care it is frequently necessary to irrigate a patient through a tracheal or endotracheal tube. Due to several factors, e.g., the position of the patient, position or location of the tube, size of the tube opening, quantity (or volume) of irrigation solution required, it has generally been necessary to draw-up from another container, the solution for irrigation into a bulb type syringe or a needle and syringe unit. The above manipulation permits the nurse to present the proper quantity of irrigating solution in a device capable of performing the task at hand. The cost in nursing time as well as the cost of the components necessary for the above system is obvious. In addition to the above cost and preparation requirements, it has been recorded that in several instances the needle through which the irrigation solution was being administered inadvertently dislodged from the syringe and dropped into the patients throat. Complications here are also obvious.

To respond to some of the many and varied requirements that the demand of better patient care places on the container in which medication is presented for administration, a few of which are illustrated above, a package, or family of packages that will permit delivery of the medication to the instrument being used in the patient, or to the patient per se, not only is in order but is necessary to support and keep pace with ever improving technology and medical practice.

SUMMARY OF THE INVENTION

The present invention relates generally to the field of single use respiratory therapy units as well as small volume irrigation units, and more particularly is directed to a non-reclosable liquid containing package including a preferred shoulder-neck-nozzle arrangement on which is located a self contained opening means which, upon removal, exposes a nozzle of correct size and shape designed to facilitate proper dispensing of the contained liquid.

The present invention includes a cluster or block of separable, individual vials suitable for storing and dispensing discreet quantities of either medicated or non-medicated solutions.

Each vial in a block is similarly configured and preferably includes front and back walls tapered or converging toward the bottom of the vial to elevate the nozzle when the vial is placed upon a table or other planer surface whereby the liquid product cannot accidentally drip from a vial after opening. Each vial is provided with a twist off opening key to expose a dispensing nozzle and orifice. Preferably the nozzle is sized to have a positive "locating" feature to fit into the medication port of a nebulizer unit, e.g., the Bird nebulizer as well as a positive "locating" feature to fit the opening of tracheal, or endotrachael tubes so that the contained solution can be properly directed into the tube and applied directly in a stream to the trachael treatment area.

Preferably the clusters of vials are arranged in a block of five vials or in a block of two times five vials to reduce storage requirements as the vials are used. The twist off keys or closures are individually arranged on the vials of a block and are not joined so that the opening of one vial will not open an adjacent vial nor will a remaining vial in a block or cluster be opened when one end vial is detached. Each vial or ampoule in a block or cluster should preferably be fabricated of an FDA approved plastic of suitable characteristics to retain therein any particular solution selected for storage and later application purposes. In the event that the plastic utilized is permeable to moisture and air, e.g., oxygen permeation, the vial clusters could be stored within outer foil, or otherwise non-gas permeable packages to thereby protect the stored contents from light and oxygen or air deterioration. Preferably the protective outer packages are swept out with nitrogen in a known procedure prior to, during, or following placement of the vial clusters into the protective outer package to further protect against air or oxygen deterioration.

It will be noted that the design of the ampoules or vials is such that when an open vial is placed upon a horizontal surface, the taper or incline of the body front or rear wall will maintain the dispensing end above the surface to thereby tend to preserve the sterile treatment of the ampoule. Additionally, the incline of the body front or rear walls positions the body opening above the level of the liquid contents of the solution in a manner to prevent inadvertant spilling or dribbling of the fluid contents from the dispensing orifice of an open vial.

It is therefore an object of the present invention to provide an improved single use vial of the type set forth.

It is another object of the present invention to provide a novel, filled single use vial which includes downwardly converging front and back walls and an integral twist off key.

It is another object of the present invention to provide a plurality of single use vials which are arranged in easily separable blocks or cluster packs.

It is another object of the present invention to provide a novel single use vial including a twist off key wherein, the removal of the key exposes a dispensing nozzle that is suitable for direct application into the entrance orifices of existing respiratory therapy and tracheal lavage devices.

It is another object of the present invention to provide a novel single use vial or ampoule that is simple in design, inexpensive in manfucture and trouble free when in use.

Other objects and a fuller understanding of the invention will be had by referring to the following description and claims of a preferred embodiment, taken in conjunction with the accompanying drawings, wherein like reference characters refer to similar parts throughout the several views and in which:

BRIEF DESCRIPTION OF THE DRAWINGS

FIG. 1 is an elevational view showing a cluster pack of five vials or ampoules.

FIG. 2 is a bottom plan view taken along line 2—2 on FIG. 1, looking in the direction of the arrows.

FIG. 3 is an enlarged, partial, elevational view showing the opening key in place at the nozzle of a vial.

FIG. 4 is partial, elevational view similar to FIG. 2 showing the removable key in phantom lines.

FIG. 5 is a partial, elevational view similar to FIG. 2 with the key removed and partially broken away to expose interior construction details.

FIG. 6 is a side elevational view of the open vial of FIG. 5 resting upon a horizontal surface, and partly broken away.

FIG. 7 is an elevational view of a cluster pack illustrating a modified vial configuration.

FIG. 8 is a bottom plan view of the cluster of FIG. 7, looking from line 8—8.

FIG. 9 is an enlarged, partial, elevational of the top of one of the vials of FIG. 6.

FIG. 10 is an enlarged, partial elevational view similar to FIG. 10 showing the opening key in phantom lines.

FIG. 11 is a side elevational view of the vial of FIG. 10 resting upon a horizontal surface, and partly broken away.

FIG. 12 is an elevational view showing a vial of FIG. 1 in use with a respiratory therapy treatment device. Vials of FIG. 7 are similarily used with a resipiratory treatment device.

FIG. 13 is an elevational view showing a vial of FIG. 1 in use with a tracheal device (patient areas not shown)

DESCRIPTION OF THE PREFERRED EMBODIMENT OF THE INVENTION

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIGS. 1 and 2 a block or cluster pack 10 comprising a plurality of similar, severable, liquid containing vials or ampoules 12 such as the cluster of edge connected vials 12*a*, 12*b*, 12*c*, 12*d*, 12*e*. The vials of the block or cluster are fabricated of suitable moldable plastic and are simultaneously molded and filled with a medicated or non-medicated treatment liquid 14 (FIG. 6) by employing existing ampoule fabricating and filling equipment well known to those skilled in the art. The individual vials 12*a*, 12*b*, 12*c*, 12*d*, 12*e* are preferably secured along tear strips or seams 36 to facilatate separation of individual, single service containers. The cluster pack provides an orderly, compact arrangement for convenient storage of a plurality of vials in a cabinet, desk, pocket, etc. Preferably, the individual vials 12 are arranged in clusters 10 of five vials as illustrated or in two time five vial clusters to provide for the user both a convenient means of storage and transportation and also a rapid accounting of the supply on hand. Each vial contains a known quantity of treatment liquid 14, for example, 5.0 ml capacity.

Referring now to FIGS. 3, 4 and 5, it will be seen that each vial 12 is upwardly provided with a dispensing nozzle 16 which extends forwardly of a cylindrical boss or flange 18. The vial 12 is preferably molded or otherwise formed to a generally trapazoidal longitudinal cross sectional configuration (FIG. 6) and includes flat, downwardly converging front and rear walls 28, 30. The front and rear walls are interconnected by respective left and right sidewalls 32, 34 to define a hollow interior 40 suitable for retaining a measured quantity of medicated or non-medicated treatment liquid 14 therewithin. The front and rear walls 28, 30 and the sidewalls 32, 34 converge upwardly and define a narrow neck 20. A transistion channel 22 interconnects the neck 20 the dispensing boss or flange 18.

Still referring to FIGS. 3, 4 and 5, a twist off opening key 26 includes a grasping area 42 and an air tight seal 44 to initially provide a top closure for the vial 12. The key 26 is defined from the top of the dispensing nozzle 16 by a weakened seam 46, which seam is formed when the vial 12 is molded or otherwise fabricated. Accordingly, when it is desired to use the treatment liquid 14 contained within a vial 12, the opening key 26 is grasped by the fingers (not shown) of the user and is twisted about the weakened seam 46 until the sealing portion 44 separates from the dispensing nozzle 16, thereby exposing the outer end of the dispensing conduit 24. As best seen in FIGS. 5 and 6, the dispensing conduit 24 is in continuous fluid communication with the interior 40 of the vial 12 to permit dispensing of the treatment of the liquid 14 after removal of the opening key 26. As best seen in FIG. 1, it is noteworthy the the twist off opening keys 26 are individually formed and are not interconnected or otherwise joined so that the opening or removal of one vial, for example vial 12*a*, will not cause opening of the adjacent vial 12*b*. The complete separation of adjacent opening keys 26 will prevent a vial remaining in the block or cluster 10 from inadvertently being opened when one vial or ampoule is detached for use along a separation strip 36.

Referring now to FIG. 6, it is noteworthy that when a vial opening key 26 is removed and the vial is placed upon a flat, horizontal surface 38, such as a table top, the flat, tapered shape and orientation of a front wall or rear wall 28, 30 will prevent rolling or tipping and will maintain the nozzle 16 and conduit 24 well above the horizontal surface 38 and out of contact, hence possible contamination by contact, with surface 38. Additionally, the surface 48 of the treatment liquid 14 will be maintained below the level of the dispensing conduit 24 and thus will prevent inadvertant leakage of the treatment liquid from the vial prior to the intended use.

Referring now to FIGS. 7 and 8, a modified block or cluster 10' comprising a plurality of individual vials or ampoules 50 is illustrated. Each block or cluster 10' preferably includes a plurality of five vials or ampoules 50 or two times five vials or ampoules to thereby require a minimum of storing space. These individual vials 50 are separable one from the other along the scored separation lines 36'. The individual vials 50 are preferably employed as single use, respiratory therapy units and each contains a known quantity of treatment liquid 14, for example 0.5 ml capacity.

The modified vials 50 are generally diamond shaped in longitudinal cross section (FIG. 11) and include converging front and rear base surfaces 52, 54 and interconnected, flat, converging front and rear upper surfaces 56, 58. The front and rear walls 52, 56 and 54, 58 are laterally joined by interconnecting respective left and right sidewalls 60, 62 to define hollow interior storage spaces 64 for receipt and storage of a measured quantity of medicated or non-medicated treatment liquid 14 therewithin. The front and rear upper walls 56, 58 and the upper portions of the left and right sidewalls 60, 62 converge upwardly to define a generally cylindrical dipensing neck 66 within which is formed a liquid dispensing channel 68. The channel 68 is in fluid communication with the vial interior 64 to facilitate dispensing of the stored treatment liquid 14 in the manner hereinafter more fully set forth.

As best seen in FIGS. 9 and 10, each modified vial 50 is provided with a twist off type opening key 26', which key includes a grasping portion 42' and a sealing portion 44' similar to the key 26 as hereinbefore set forth. By twisting the key 26' at the grasping area 42', the sealing section 44' will be separated from the vial dispensing neck 66 along the weakened seam 46' to thus expose the outer end of the dispensing channel 68 for fluid dispensing purposes.

Referring now to FIG. 11, the modified vial or ampoule 50 is illustrated at rest upon a horizontal surface 38, such as a table top. As illustrated, the opening key 26' has been removed to expose the end of the dispensing channel 68. The geometry of the configuration of the vial assures that the dispensing nozzle 66 will rest well above the surface 38 to prevent possible contamination therefrom. One of the front or rear base surfaces 52, 54 is applied directly upon the table surface 38 in stable manner to prevent rolling, tipping or other movement of the vial 50 until ready for use. In this resting position, it will be noted that the liquid surface 48 will be maintained within the vial interior surface 54 below the open end of the dispensing channel 68 to thereby prevent premature dispensing or loss of the treatment liquid 14 prior to actual use.

In order to use a single use vial 12 or 50, an individual vial 12, 50 is first removed from its associated cluster or pack 10, 10' by separation along a respective separation strip 36, 36'. The opening key 26, 26' is then twisted or otherwise manipulated to sever the key from the respective dispensing nozzle 16, 66 along the weakend seam 46, 46'. Vial 12, when being used in a respiratory therapy application, can then be applied to a medication port 70 of a known type of nebulizer housing generally designated 74, for treatment liquid application purposes. Preferably, the dispensing nozzles 16, 66 are designed of outer diameter and of suitable configuration to be universally adaptable for application, at all known nebulizer medication ports, for example, the port 70 of a respiratory therapy treatment unit. The small nozzle 16, 66 is particularly designed of configuration to fit directly within the medication port of the "Bird" brand nebulizer. In the case of treatment units for tracheal and/or endotracheal devices 76, the vial 12 may be directly applied by interfitting the neck 20, down to the shoulder of vial 12 into the tracheal device to properly align and fit the dispensing nozzle. The small size of the vial dispensing conduit 24 in cooperation with the nozzle 16, permits the treatment liquid to be applied interiorly of the treacheal unit 76 in a positive stream when the flat front and rear walls 28, 30 are squeezed. It is noteworthy that the fingers of the user never touch the dispensing nozzle 16, 66 of either vial configuraton 12, 50. Therefore, the dispensing channels 24, 68 will remain free from touch contamination after opening since the fingers do not touch or otherwise contact the dispensing channel or orifice.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. In a single use, non-reclosable vial having a squeezable closed body, an intermediate neck and an initially closed dispensing nozzle, said vial containing a medicated or non-medicated solution to be administered to a patient for respiratory therapy; the improvement which comprises:

(a) said nozzle having a circular cross-section and a diameter sized to fit snugly in the medication port of a Bird nebulizer and into the inner solution-receiving port of standard tracheal and endotracheal devices;

(b) said neck including a cylindrical flange having a diameter larger than the medication port of a Bird nebulizer;

(c) said cylindrical flange being connected to the lower substantially cylindrical portion of said neck adjacent the body of said vial by an intermediate transition channel of reduced diameter; and (d) said lower substantially cylindrical portion of the neck having a circular cross-section and a diameter larger than said reduced diameter and such that it fits snugly within the internal diameter of standard tracheal and endotracheal devices.

2. In a single use, non-reclosable vial having a squeezable closed body, an intermediate neck and an initially closed dispensing nozzle, said vial containing a medicated or non-medicated solution to be administered to a patient for respiratory therapy; the improvement which comprises:

(a) said nozzle having a circular cross-section and an outer diameter such that it fits directly and snugly within the medication port of a Bird nebulizer to ensure positive introduction of the solution thereto and into the inner solution-receiving port of standard tracheal and endotracheal devices;

(b) said neck including a cylindrical flange which abuts the outside of the medication port of said Bird nebulizer to prevent over-insertion of the nozzle of said vial into said port;

(c) said cylindrical flange being connected to the lower substantially cylindrical portion of the neck adjacent the body of said vial by an intermediate transition channel of reduced diameter;

(d) said lower substantially cylindrical portion of the neck having a circular cross-section and a diameter such that it snugly interfits the internal diameter of standard tracheal and endotrocheal devices to properly align the dispensing nozzle for positive dispensing of said solution therein whereby said flange completely closes and seals the medication port of a Bird nebulizer when inserted therein in positive locking engagement; and whereby said lower portion of the neck serves to ensure that the dispensing nozzle is properly positioned in a standard tracheal or endotracheal device when inserted therein, and prevents over or under insertion therein or damage to said nozzle or the device in which it is inserted.

* * * * *